US005692716A

United States Patent [19]

Himmelsbach

[11] Patent Number: 5,692,716

[45] Date of Patent: Dec. 2, 1997

[54] QUIVER SUPPORT

[76] Inventor: Bryant D. Himmelsbach, 2700 Hwy 40-61, O'Fallon, Mo. 63366

[21] Appl. No.: 645,294

[22] Filed: May 13, 1996

[51] Int. Cl.[6] ..... A47B 96/06

[52] U.S. Cl. ..... 248/216.1; 135/16; 248/217.1; 248/230.8

[58] Field of Search ..... 248/216.1, 216.4, 248/217.1, 217.3, 218.4, 219.1, 219.4, 230.8; 135/16

[56] References Cited

U.S. PATENT DOCUMENTS

| | | | |
|---|---|---|---|
| 493,161 | 3/1893 | Grau | 248/217.1 X |
| 534,059 | 2/1895 | Anderson | 248/217.1 |
| 811,254 | 1/1906 | Smith | 248/216.4 X |
| 1,206,574 | 11/1916 | Miller | 248/217.1 X |
| 1,408,900 | 3/1922 | Miller et al. | 248/230.8 |
| 3,345,028 | 10/1967 | Lawrie | 248/230.8 |
| 3,785,604 | 1/1974 | Steck | 248/230.8 |
| 4,722,501 | 2/1988 | Ruhl | 248/218.4 |
| 5,310,151 | 5/1994 | Engel | 248/219.4 X |
| 5,337,986 | 8/1994 | Vollink | 248/219.4 X |

*Primary Examiner*—Alvin C. Chin-Shue
*Assistant Examiner*—Derek J. Berger

[57] ABSTRACT

The present invention relates to a quiver support which is specifically adapted to support a quiver and associated equipment within a tree, for example in conjunction with a tree blind. In its broadest context, the present invention includes a L-shaped support member defined by a short leg and a long leg. The short leg includes a number of tree engaging spikes secured thereon. The long leg includes a quiver supporting bracket secured at its distal extent.

4 Claims, 3 Drawing Sheets

FIG 3
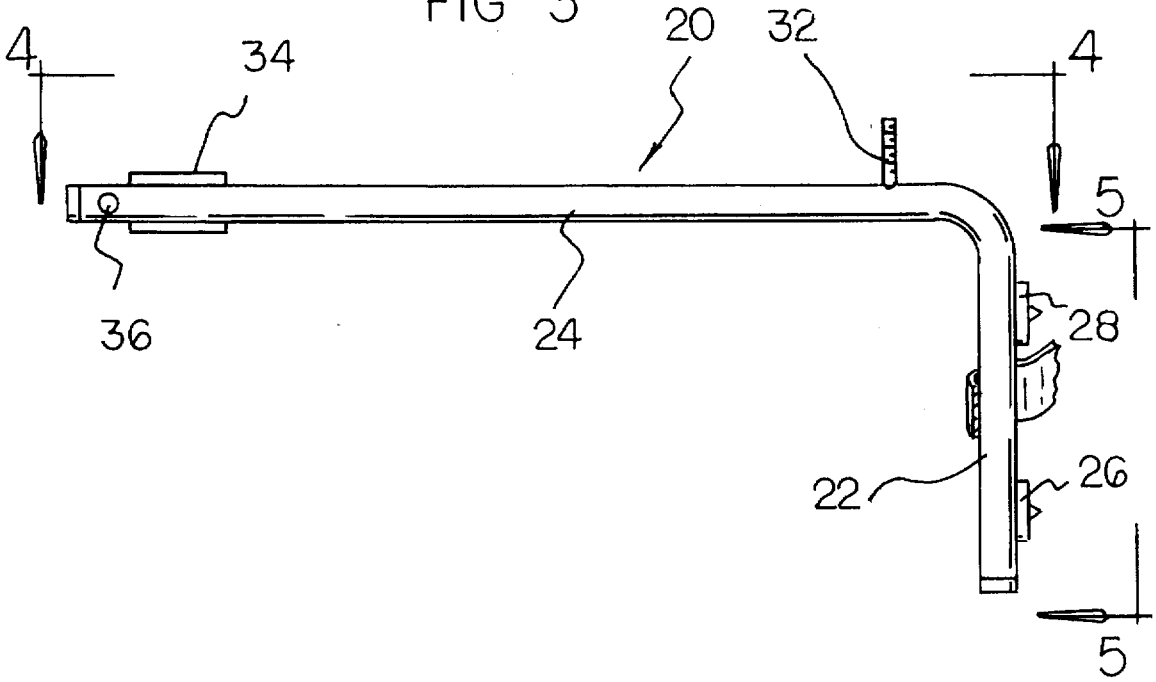
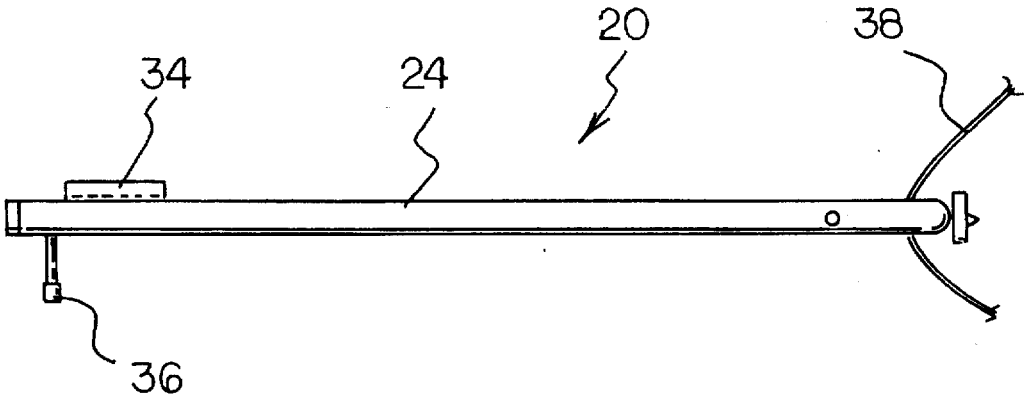
FIG 4

QUIVER SUPPORT

BACKGROUND OF THE INVENTION

1. Field of the Invention

The present invention relates to quiver support and more particularly pertains to such a support adapted for use in a tree.

2. Description of the Prior Art

The use of bow holders is known in the prior art. More specifically, bow holders heretofore devised and utilized for the purpose of supporting a bow are known to consist basically of familiar, expected, and obvious structural configurations, notwithstanding the myriad of designs encompassed by the crowded prior art which has been developed for the fulfillment of countless objectives and requirements.

For example U.S. Pat. Nos. 5,310,150 to Fecko; 5,437,377 to Riemenschneider; Des. 316,780 to Chilcutt et al.; 5,183,231 to Pellerin; 4,936,415 to Williams each disclose arrow and or bow holders. Furthermore, U.S. Pat. No. 5,114,107 to Mahn et al. discloses an apparatus for supporting archery equipment.

In this respect, the quiver support according to the present invention substantially departs from the conventional concepts and designs of the prior art, and in doing so provides an apparatus primarily developed for the purpose of supporting a quiver within a tree.

Therefore, it can be appreciated that there exists a continuing need for new and improved quiver support which can be used for supporting a quiver within a tree. In this regard, the present invention substantially fulfills this need.

SUMMARY OF THE INVENTION

In view of the foregoing disadvantages inherent in the known types of bow holders now present in the prior art, the present invention provides an improved quiver support. As such, the general purpose of the present invention, which will be described subsequently in greater detail, is to provide a new and improved quiver support and method which has all the advantages of the prior art and none of the disadvantages.

To attain this, the present invention essentially comprises a quiver support specifically adapted to support a quiver and associated equipment in a tree, the support comprises an L-shaped support member having a short leg and a long leg oriented 90 relative to one another. The short leg has a first end and a second end and an intermediate extent therebetween; the long leg has a first end and a second end and an intermediate extent therebetween. The second end of the short leg is integral with the first end of the long leg. The support includes a first tree engaging spike secured adjacent the first end of the short leg, and a second tree engaging spike secured to the intermediate extent of the short leg. An umbrella supporting post is secured to the long leg adjacent the first end. Additionally, a quiver holding bracket having a closed end and an opened end is included with the closed end being secured to the second end of the long leg. A bow supporting post is secured to the second end of the long leg opposite the quiver holding bracket. A strap is employed in securing the support. The strap has a first end and a second end and an intermediate extent therebetween. The intermediate extent of the strap is adapted to engage the intermediate extent of the short leg, and a ratchet is adapted to adjustably secure the first and second ends of the strap together.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved quiver support which have all the advantages of the prior art bow holders and none of the disadvantages.

It is another object of the present invention to provide new and improved quiver support which may be easily and efficiently manufactured and marketed.

It is further object of the present invention to provide new and improved quiver support which are of durable and reliable constructions.

An even further object of the present invention is to provide new and improved quiver support which are susceptible of a low cost of manufacture with regard to both materials and labor, and which accordingly are then susceptible of low prices of sale to the consuming public, thereby making such quiver support economically available to the buying public.

Still yet another object of the present invention is to provide new and improved quiver support which provide in the apparatuses and methods of the prior art some of the advantages thereof, while simultaneously overcoming some of the disadvantages normally associated therewith.

Even still another object of the present invention is to provide a means for supporting a quiver within a tree.

Lastly, it is an object of the present invention to provide new and improved quiver support which is specifically adapted to support a quiver and associated equipment within a tree, for example in conjunction with a tree blind. In its broadest context, the present invention includes a L-shaped support member defined by a short leg and a long leg. The short leg includes a number of tree engaging spikes secured thereon. The long leg includes a quiver supporting bracket secured at its distal extent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the quiver support.

FIG. 4 is plan view of the quiver support.

The same reference numerals refer to the same parts through the various Figures.

DESCRIPTION OF THE PREFERRED EMBODIMENT

Figure 1:
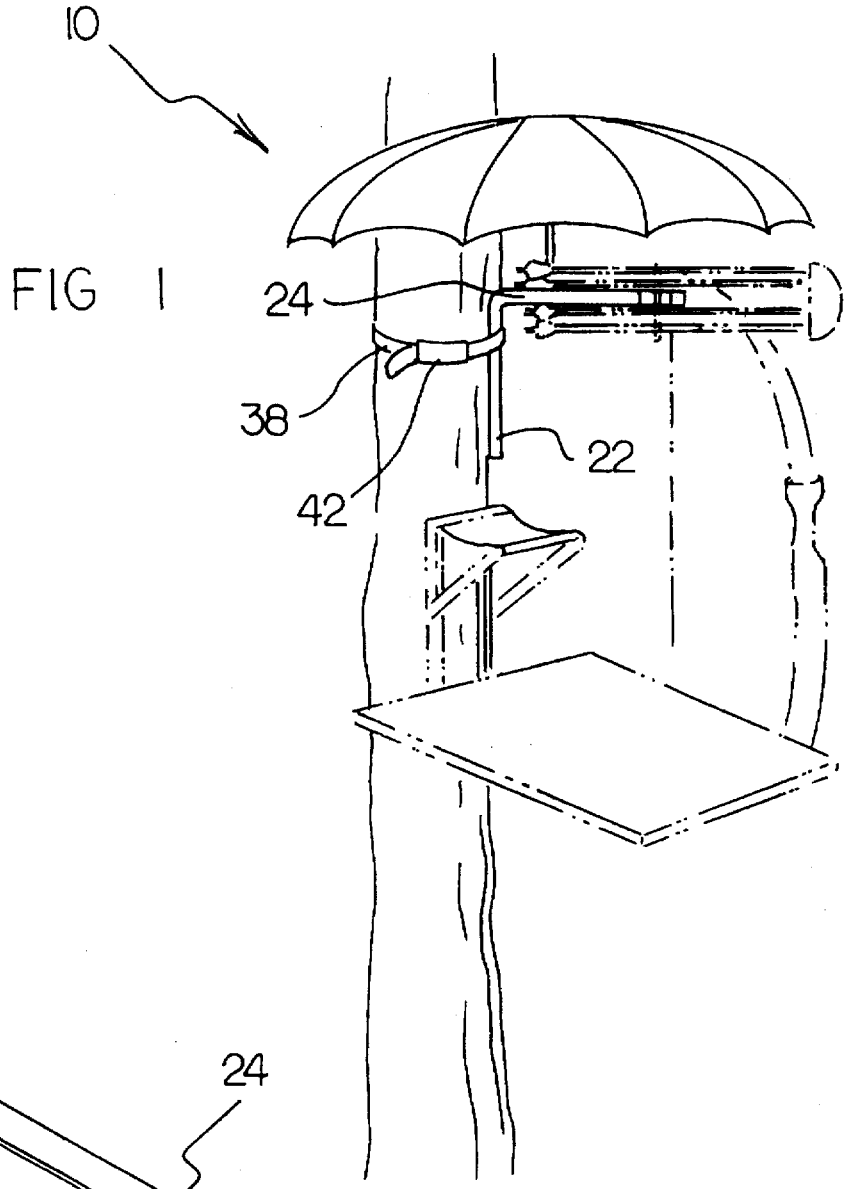
FIG. 1 is a perspective view of the preferred embodiment of the quiver support constructed in accordance with the principles of the present invention.

With reference now to the drawings, and in particular to FIG. 1 thereof, the preferred embodiment of the new and improved quiver support embodying the principles and concepts of the present invention and generally designated by the reference numeral 10 will be described.

The present invention relates to a quiver support which is specifically adapted to support a quiver and associated equipment within a tree, for example in conjunction with a tree blind. In its broadest context, the present invention includes a L-shaped support member defined by a short leg and a long leg. The short leg includes a number of tree engaging spikes secured thereon. The long leg includes a quiver supporting bracket secured at its distal extent. The various components of the present invention, and the manner in which they interrelate, will be described in greater detail hereinafter.

Figure 2:
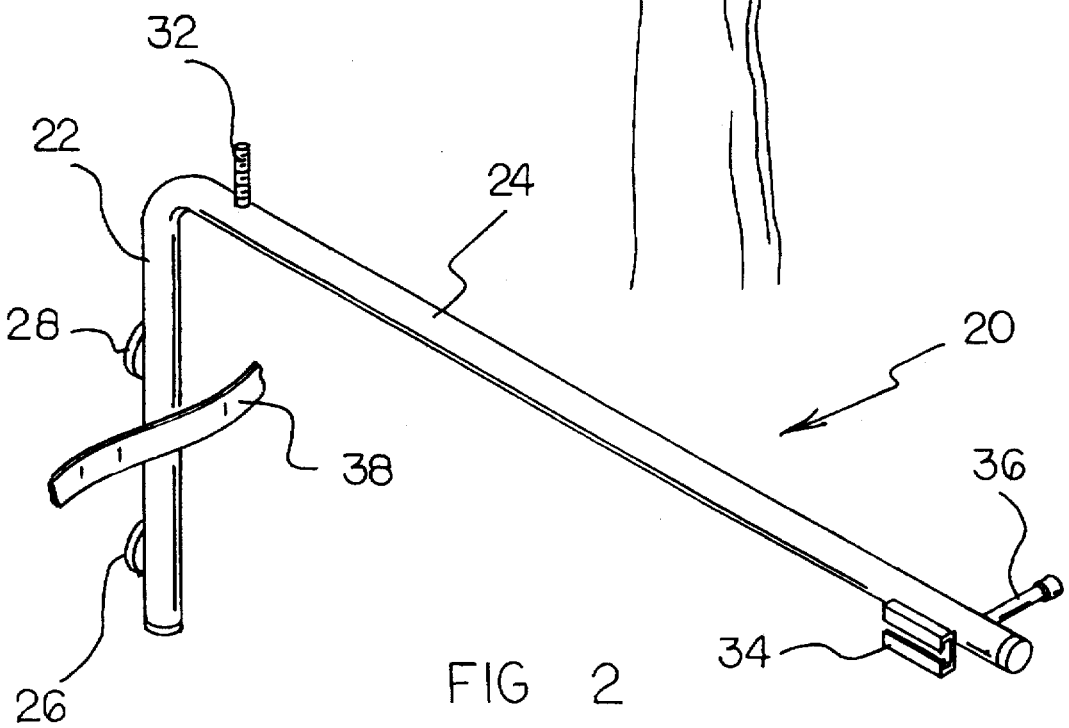
FIG. 2 is a perspective view of the quiver support.

The main component of the present invention is the L-shaped support member 20. The L-shaped support member 20 is defined by a short leg 22 and a long leg 24 which are oriented 90 relative to one another. The short leg 22 is defined by a first end and a second end and an intermediate extent therebetween. Likewise, the long leg 24 is defined by a first end and a second end and an intermediate extent therebetween. The second end of the short leg 22 is integral with the first end of the long leg 24. Removable end caps are removable secured to the outer ends of the tubular L-shaped support member 20. The overall configuration of the support member is illustrated in FIGS. 2 and 3.

Figure 5:
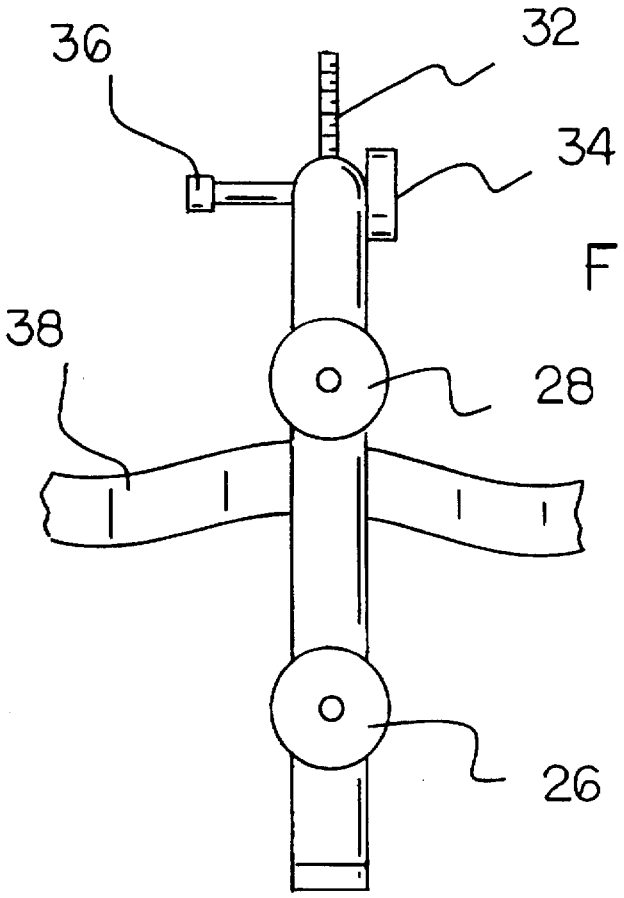
FIG. 5 is a view taken along line 5—5 of FIG. 3.
Figure 6:
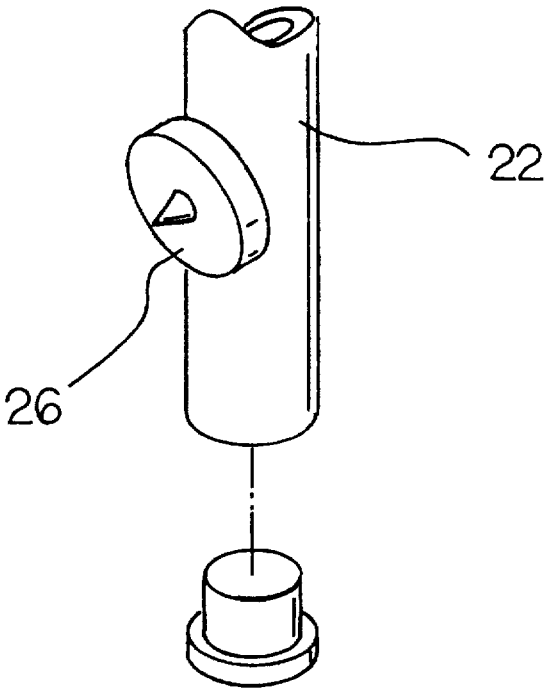
FIG. 6 is a view of one of the end caps employed in conjunction with the present invention.

In order to facilitate the securement of the L-shaped support member 20 to a tree a number of tree engaging spikes are employed. More specifically, a first tree engaging spike 26 is secured adjacent the first end of the short leg 22, and a second tree engaging spike 28 is secured to the intermediate extent of the short leg 22. The relative orientation of the two tree engaging spikes is best illustrated in FIG. 5. Furthermore, as illustrated in the figures, each of the spikes includes a circular base member.

In order to facilitate the use of the present invention in conjunction with an umbrella, an umbrella support is provided. More specifically, an umbrella supporting post 32 is secured to the long leg 24 adjacent the first end. This post 32 is a hollow cylindrical member which can either be inserted into or accept the handle of an umbrella. The present invention is illustrated in conjunction with an umbrella in FIG. 1.

Furthermore, the present invention is also employed in supporting a number of arrows organized by way of a quiver. This is achieved by way of a quiver holding bracket 34. This bracket 34 is defined by both a closed end and an opened end. The closed end of the bracket 34 is secured to the second end of the long leg 24. The opened end is adapted to removably receive a quiver. Additionally, a bow supporting post 36 is secured to the second end of the long leg 24 opposite the quiver holding bracket 34. The relative relationship between the quiver bracket 34 and bow supporting post 36 is best illustrated in FIG. 2. This bow supporting post 36 enables a user of the device to rest their bow upon the post 36.

The manner in which the present invention is secured to a tree will next be described. As illustrated in FIG. 1, a strap 38 is employed in securing the L-shaped support to a tree. The strap 38 associated with the present invention is defined by a first end and a second end and an intermediate extent therebetween. The intermediate extent of the strap 38 is adapted to engage the intermediate extent of the short leg 22. Furthermore, a ratchet 42 is adapted to adjustably secure the first and second ends of the strap 38 together.

Thus, in use a user initially secures the short leg of the present invention to a tree by way of the tree spikes. Next, the strap is secured about the circumference of the tree and about the short leg of the L-shaped support. The strap is made tight by way of the ratchet. As illustrated in FIG. 1, the L-shaped support should be secured above an existing tree blind or support. In this configuration, a user can readily support a quiver by way of the bracket, or a bow by way of the post. Furthermore, an umbrella can be supported over the user by way of the umbrella support.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A quiver support specifically adapted to support a quiver and associated equipment in a tree, the support comprising in combination:

an L-shaped support member having a short leg and a long leg oriented 90 relative to one another, the short leg having a first end and a second end and an intermediate extent therebetween, the long leg having a first end and a second end and an intermediate extent therebetween, the second end of the short leg being integral with the first end of the long leg;

a first tree engaging spike secured adjacent the first end of the short leg, a second tree engaging spike secured to the intermediate extent of the short leg;

an umbrella supporting post secured to the long leg adjacent the first end an umbrella secured to the supporting post;

a quiver holding bracket having a closed end and an opened end, the closed end being secured to the second end of the long leg;

a bow supporting post secured to the second end of the long leg opposite the quiver holding bracket;

a strap having a first end and a second end and an intermediate extent therebetween, the intermediate extent of the strap adapted to engage the intermediate extent of the short leg, a ratchet adapted to adjustably secure the first and second ends of the strap together.

2. A quiver support specifically adapted to support a quiver and associated equipment in a tree, the support comprising in combination:

an L-shaped support member having a short leg and a long leg oriented 90 relative to one another, the short leg having a first end and a second end and an intermediate extent therebetween, the long leg having a first end and a second end and an intermediate extent therebetween, the second end of the short leg being integral with the first end of the long leg;

a first tree engaging spike secured adjacent the first end of the short leg, a second tree engaging spike secured to the intermediate extent of the short leg;

a quiver holding bracket having a closed end and an opened end, the closed end being secured to the second end of the long leg;

an umbrella supporting post secured to the long leg adjacent the first end;

an umbrella secured to the supporting post.

3. The quiver support as described in claim 2 further comprising:

a strap having a first end and a second end and an intermediate extent therebetween, the intermediate extent of the strap adapted to engage the intermediate extent of the short leg, a ratchet adapted to adjustably secure the first and second ends of the strap together.

4. The quiver support as described in claim 2 further comprising:

a bow supporting post secured to the second end of the long leg opposite the quiver holding bracket.

* * * * *